US006305893B1

(12) United States Patent
Lee

(10) Patent No.: US 6,305,893 B1
(45) Date of Patent: Oct. 23, 2001

(54) ALBUM AND BINDING METHOD THEREFOR

(76) Inventor: Ho Chou Lee, P.O. Box 55-175, Taichung (TW)

( * ) Notice: Subject to any disclaimer, the term of this patent is extended or adjusted under 35 U.S.C. 154(b) by 0 days.

(21) Appl. No.: 09/628,329

(22) Filed: Jul. 28, 2000

(51) Int. Cl.[7] ..... B42F 13/00

(52) U.S. Cl. ..... 412/8; 281/21.1; 281/22; 281/38; 281/51; 402/73; 402/79; 402/80 R; 40/124.02; 40/124.06; 40/405; 40/726; 206/455; 206/456; 206/361.1; D19/32; D19/33

(58) Field of Search ..... 281/21.1, 22, 38, 281/51; 402/79, 73, 80 R; 40/124.02, 124.06, 405, 726; 206/455, 456, 361.1; D19/32, 33; 412/8

(56) References Cited

U.S. PATENT DOCUMENTS

| | | | | |
|---|---|---|---|---|
| 3,869,820 | * | 3/1975 | Holson | 40/124.1 |
| 5,599,128 | * | 2/1997 | Steiner | 402/79 |
| 6,039,495 | * | 3/2000 | Zimmerman et al. | 402/79 |
| 6,099,189 | * | 8/2000 | Owen et al. | 402/79 |
| 6,135,663 | * | 10/2000 | Tan | 402/79 |

* cited by examiner

*Primary Examiner*—Henry Tsai
*Assistant Examiner*—Mark T. Henderson

(57) ABSTRACT

An album comprising a plurality of leaves each having a projection on one side and a matingly shaped recess on the opposed side, wherein the leaves are stacked on a base in which the projection of one leaf is aligned and registered with the recess of an adjacent leaf, the leaves are pressed with a platen in which adhesive paste is applied on the binding sides of the leaves and is removed after the adhesive paste is cured.

5 Claims, 18 Drawing Sheets

ALBUM AND BINDING METHOD THEREFOR

FIELD OF THE INVENTION

The present invention relates to the art binding and more particularly to a do-it-yourself (DIY) based album and binding method therefor.

BACKGROUND OF THE INVENTION

DIY products have been popular among consumers. DIY has the benefits of satisfying consumers and reducing the manufacturing cost. For example, commercially available albums typically have predetermined pages. A consumer may buy one based on his/her needs such as one album for mounting pictures taken in a journey. However, this ideal album is not easy to find. In many cases, one has to buy an album with more pages than needed or buy several albums each having a small number of pages.

A conventional method for binding a desired plurality of leaves is shown in FIG. 1. The binding process comprises the steps of a) aligning holes 101, 111, and 121 of front board 100, leaves 120, and back board 110 respectively; b) inserting female screws 140 through holes 101, 111, and 121; and c) inserting male screws 130 to secure to female screws 140.

But this is unsatisfactory for the purpose for which the invention is concerned for the following reasons:

1. Pages may recess toward the center of binding side. As such, pages may wrinkle.
2. Screws may loose or even get lost, thus causing pages to separate.

Another conventional method for binding a desired plurality of leaves is shown in FIGS. 2 and 3. The binding process comprises the steps of a) punching a projection 200 on one side of a leaf, a perforation 210 along the inner edge of projection 200, a perforation 220 on the center of leaf parallel to perforation 210, and a matingly shaped recess 230 on the other opposed side of leaf, b) folding projection 200 toward recess 230 with respect to perforation 220; and c) repeating step a) and b) until a desired plurality of leaves are bound.

But this is still unsatisfactory for the purpose for which the invention is concerned for the following reasons:

1. It is required to register and adhere projection 200 to recess 230 in binding each leaf As such, 29 times of above process are performed in binding an album having 30 pages. In view of this, it is time consuming and tedious.
2. The quality of finished album depends mainly on the skill on an experienced worker. It is not reliable.
3. The original album may be messy after user adds additional leaves to the album.

It is observed by the inventor of the invention that paper is sensitive to temperature and humidity, and quality of paper is a key to a good album. In selecting leaf of album, the absorption of water of paper is a major concern. It is understood that paper with a low acceptable absorption of water may not cause curl, fold or damaged edges. Also, most albums do not provide fastening arrangement for mounting pictures. As such, the mounted pictures are messy in most cases. Even in albums having fastening arrangement and/or edge decoration, its design still suffered from a disadvantage. In detail, in such album color bands are stitched on three sides other than the binding side. But this requires a skilled worker to perform such job. However, a skilled worker may not be found easily.

Thus, it is desirable to provide a novel album and binding method therefor in order to overcome the above drawbacks of prior art.

SUMMARY OF THE INVENTION

It is an object of the present invention to provide an album binding method comprising the steps of a) preparing a plurality of leaves each having a projection one side and a matingly shaped recess on the opposed side; b) stacking the leaves on a base and aligning the projection of one leaf with the recess of the adjacent leaf; c) registering the aligned leaves; d) pressing the leaves with a platen; e) applying adhesive paste on the binding sides of the leaves; and f) removing the platen after the adhesive paste is cured.

It is another object of the present invention to provide an album binding method wherein the number of prepared leaves is based on individual needs, thus avoiding waste.

It is still another object of the present invention to provide an album wherein each page of the album has a plurality of holes arranged in rows and columns, resulting in a reduction of weight and strain of paper caused by the variation of temperature and humidity.

It is a further object of the present invention to provide an album wherein each page has a plurality of mounting spaces for mounting pictures. With this, the thickness of the album can be maintained the same.

The above and other objects, features and advantages of the present invention will become apparent from the following detailed description taken with the accompanying drawings.

DETAILED DESCRIPTION OF THE PREFERRED EMBODIMENTS

Figure 1:
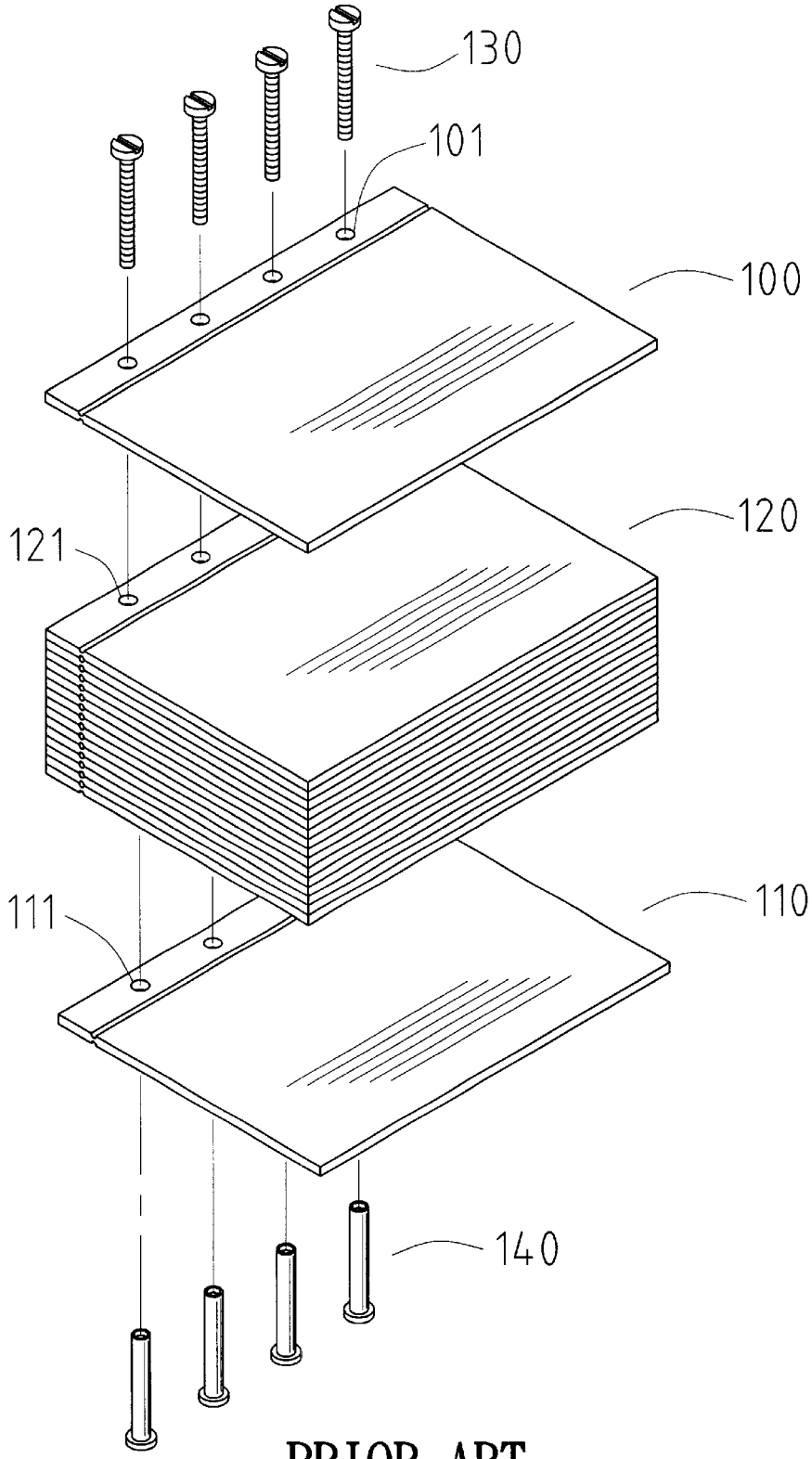
PRIOR ART FIG. 1
FIG. 1 is an exploded view illustrating a conventional album binding method.
Figure 2:
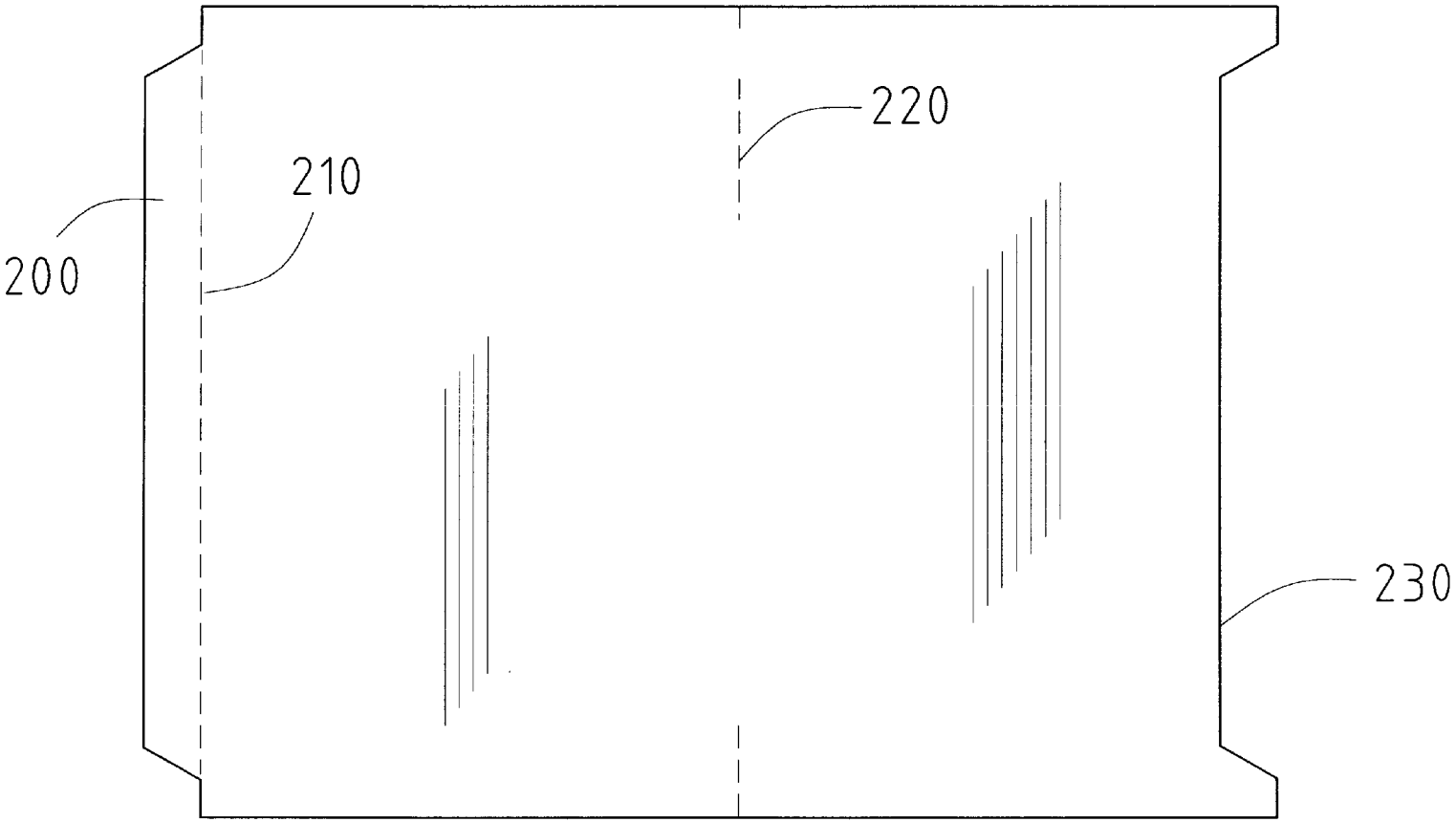
PRIOR ART FIG. 2
FIG. 2 is a plan view of a leaf for preparing another conventional album.
Figure 3:
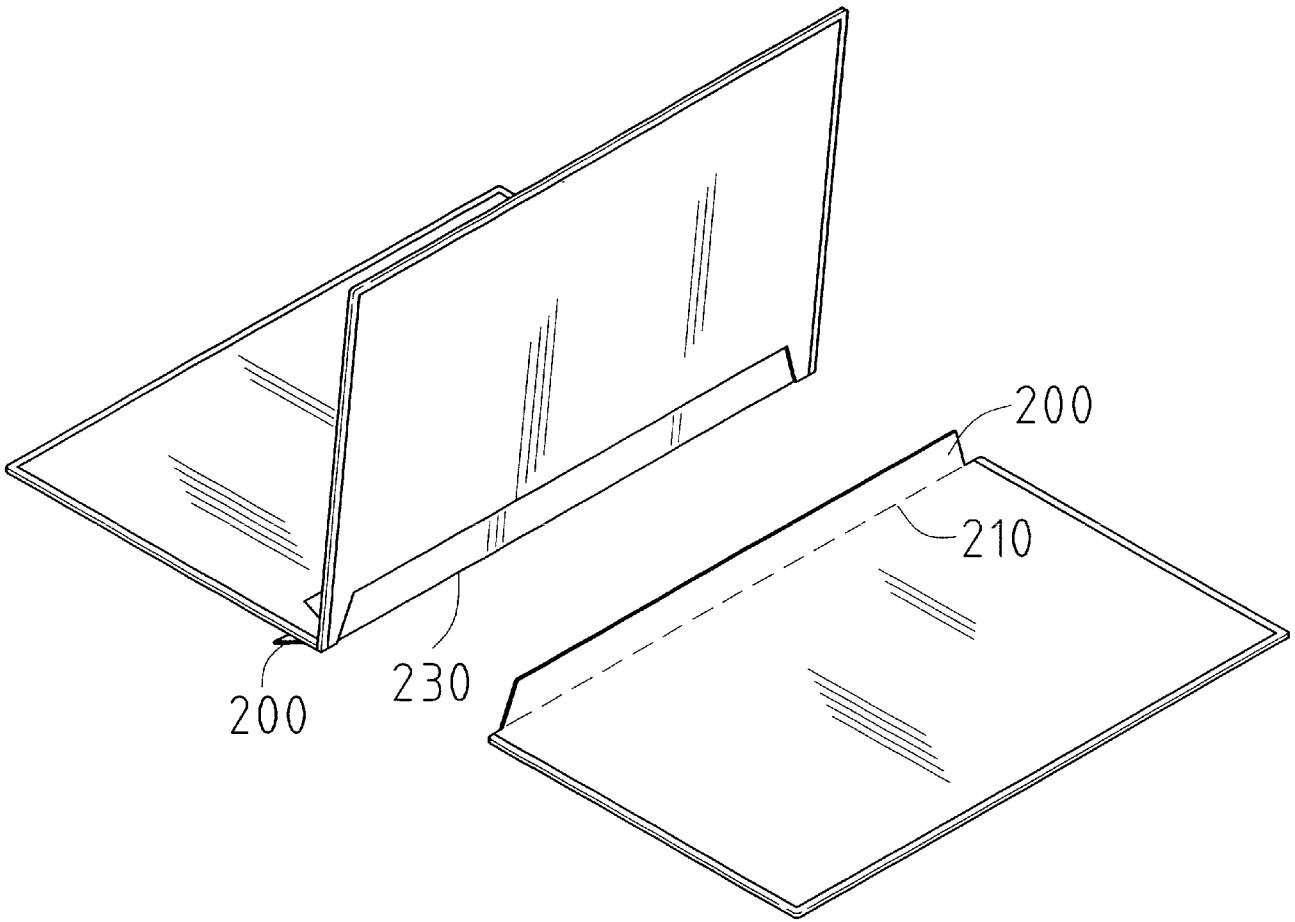
PRIOR ART FIG. 3
FIG. 3 is an exploded perspective view of the leaf of FIG. 2, where leaf been folded.
Figure 4:
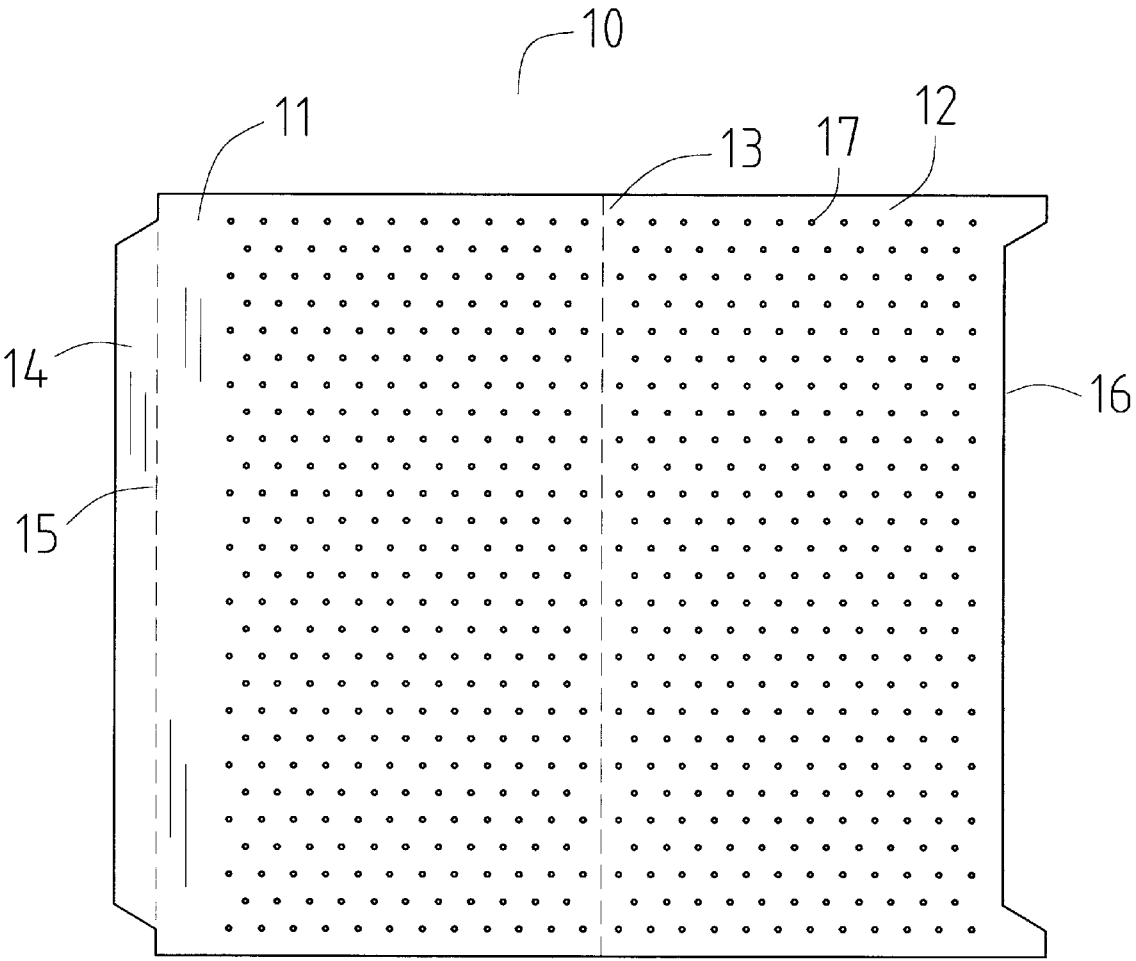
FIG. 4 is a plane view of a first preferred embodiment of leaf according to the invention.
Figure 5:
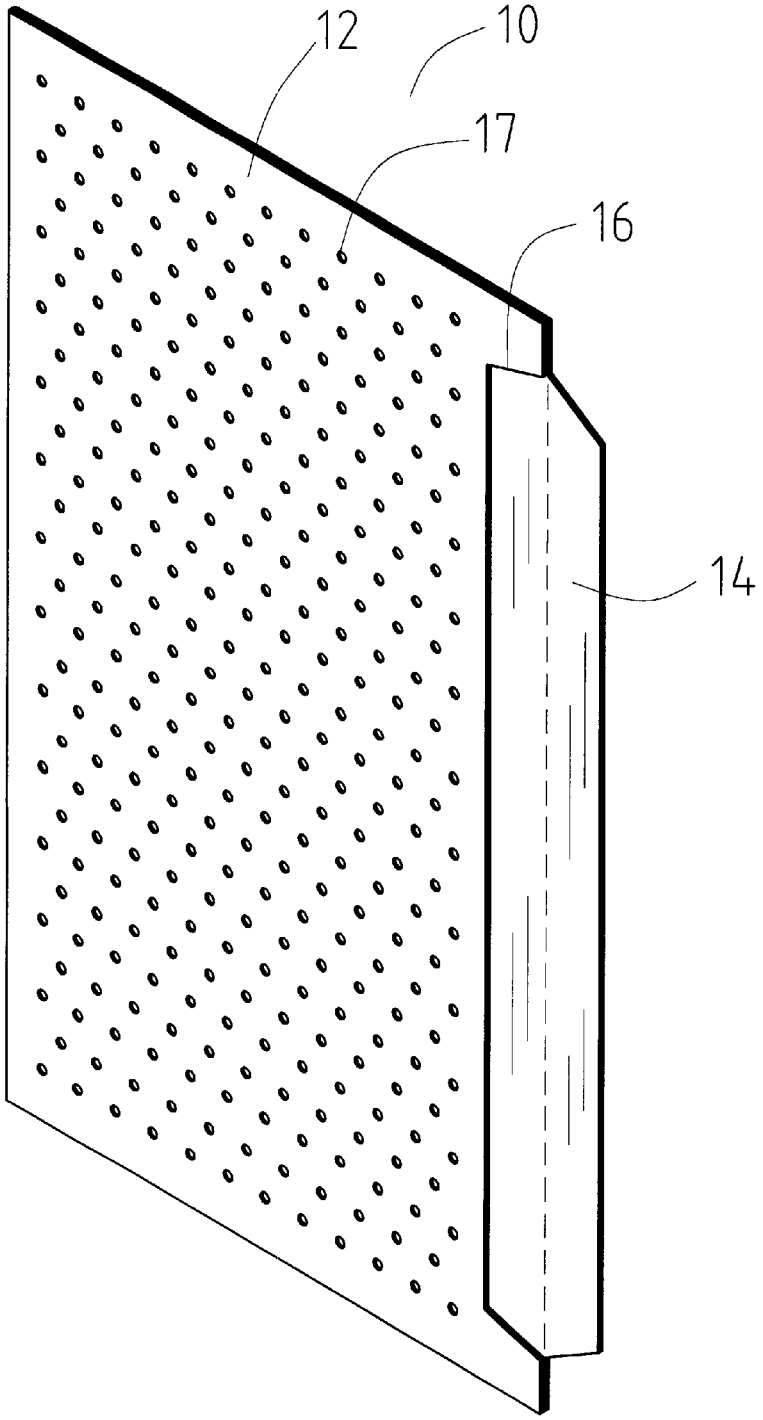
FIG. 5 is a perspective view of the folded leaf of FIG. 4.

Referring to FIGS. 4 and 5, the album binding method in accordance with the invention is illustrated. The method comprises the step of preparing a plurality of leaves 10, punching a first perforation 13 on the center of each leaf 10 to form a first half leaf 11 and a second half leaf 12, a projection 14 on one side of leaf 10, a second perforation 15 along the inner edge of projection 14, and a matingly shaped recess 16 on the other opposed side of leaf 10. Each of half leaves 11 and 12 has a plurality of through holes 17 arranged in rows and columns wherein holes 17 in the first half leaf 11 correspond to holes 17 in the second half leaf 12. The provision of holes 17 can cut the fibers of leaf 10 into short ones for reducing weight and reducing the strain of paper (i.e., leaf 10) caused by the variation of temperature and humidity. Fold first half leaf 11 toward second half leaf 12 with respect to first perforation 13. Reversely fold projection 14 with respect to second perforation 15. As a result, two binding sides are formed, i.e., projection 14 on one side while recess 16 on the other side. This completes the preparation of a single leaf (FIG. 5).

The bore of hole 17 should be selected appropriately. It is understood that a larger bore may cause mounted picture to fall, while a smaller bore may cause curls. This is because the quality of paper tends to be adversely affected by the accumulated strain thereof and the variation of temperature and humidity.

Figure 6:
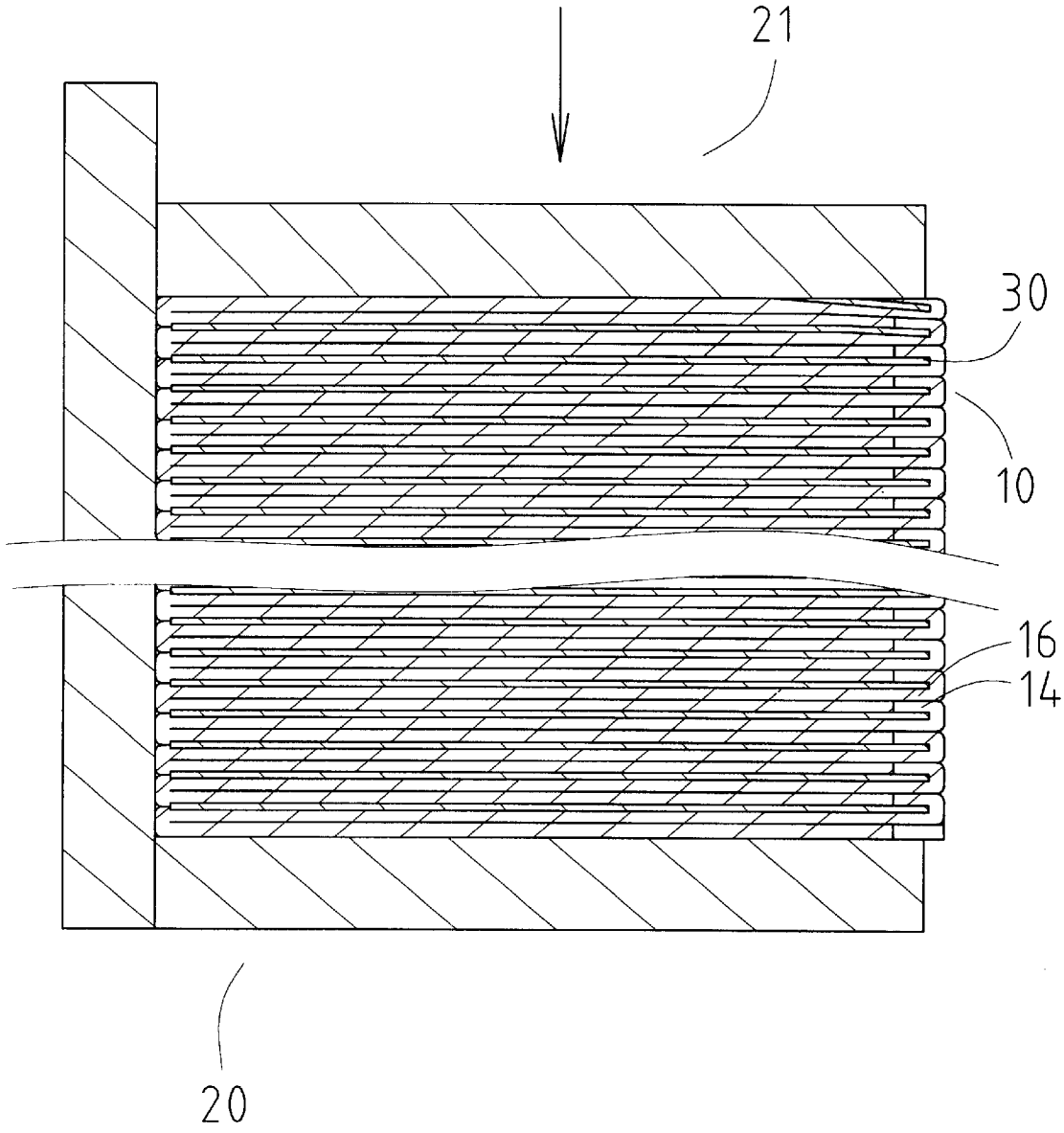
FIG. 6 is a cross-sectional view of stacked leaves of FIG. 4.

Referring to FIG. 6, the album binding method further comprises the step of stacking the leaves 10 on an L-shaped base 20, aligning the projection 14 of one leaf 10 with the recess 16 of adjacent leaf 10, and inserting a divider 30 between two adjacent leaves 10 for forming a picture mounting space. Preferably, the thickness of divider 30 is about the total thickness of two pictures. Place a platen 21 on the top leaf 10 after a suitable number of leaves 10 have been stacked. Preferably, the pressure of platen 21 applied on leaves 10 should be an optimum in order for slightly adjusting the position of leaves 10 in the subsequent step (i.e., registration step).

The album binding method further comprises the step of registering the aligned leaves 10 so as to obtain aligned sides. At this time, projection 14 of one leaf 10 registers with recess 16 of the adjacent leaf 10.

The album binding method further comprises the step of pressing the leaves 10 with platen 21 such that leaves 10 may join firmly.

Figure 7:
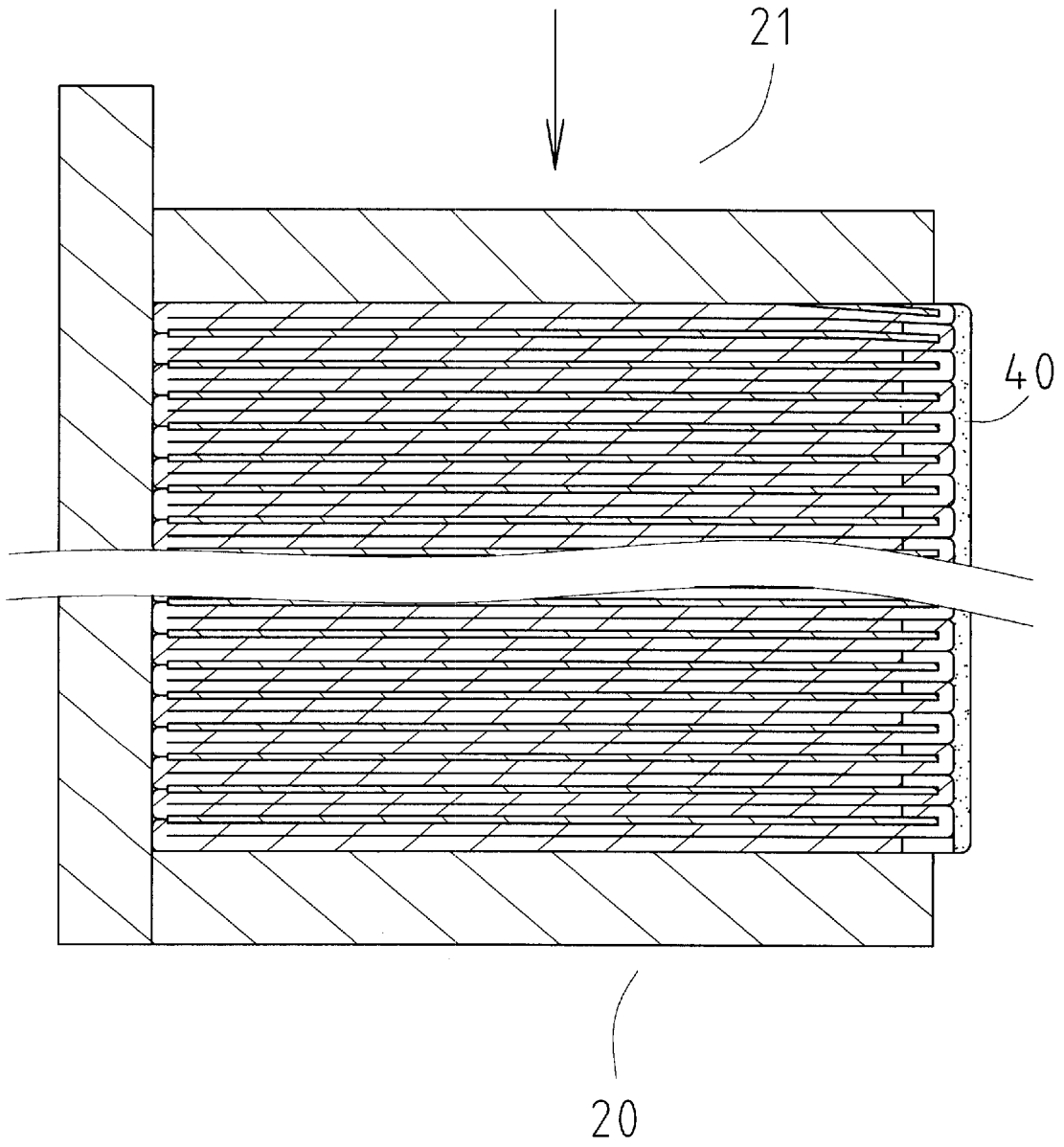
FIG. 7 is similar to FIG. 6, where adhesive paste been applied on leaves.

Referring to FIG. 7, the album binding method further comprises the step of applying adhesive paste on the binding sides of the leaves 10. An adhesive member 40 adhered to leaves 10 is formed after adhesive paste is cured. This complete the binding of a batch of leaves 10. A batch consists of, for example, 150 leaves 10 based on desired.

The album binding method further comprises the step of removing the platen 21 after the binding of album is finished. The adhesive paste may be made of resin. Preferably, adhesive paste is mixed with short fibers prior to applying on leaves 10 in order to increase the adhesion of adhesive member 40.

The registration of leaves 10 is done in a single step, thus eliminating the tedious work of individual registration of prior art. This is a quick and effective technique.

Figure 8:
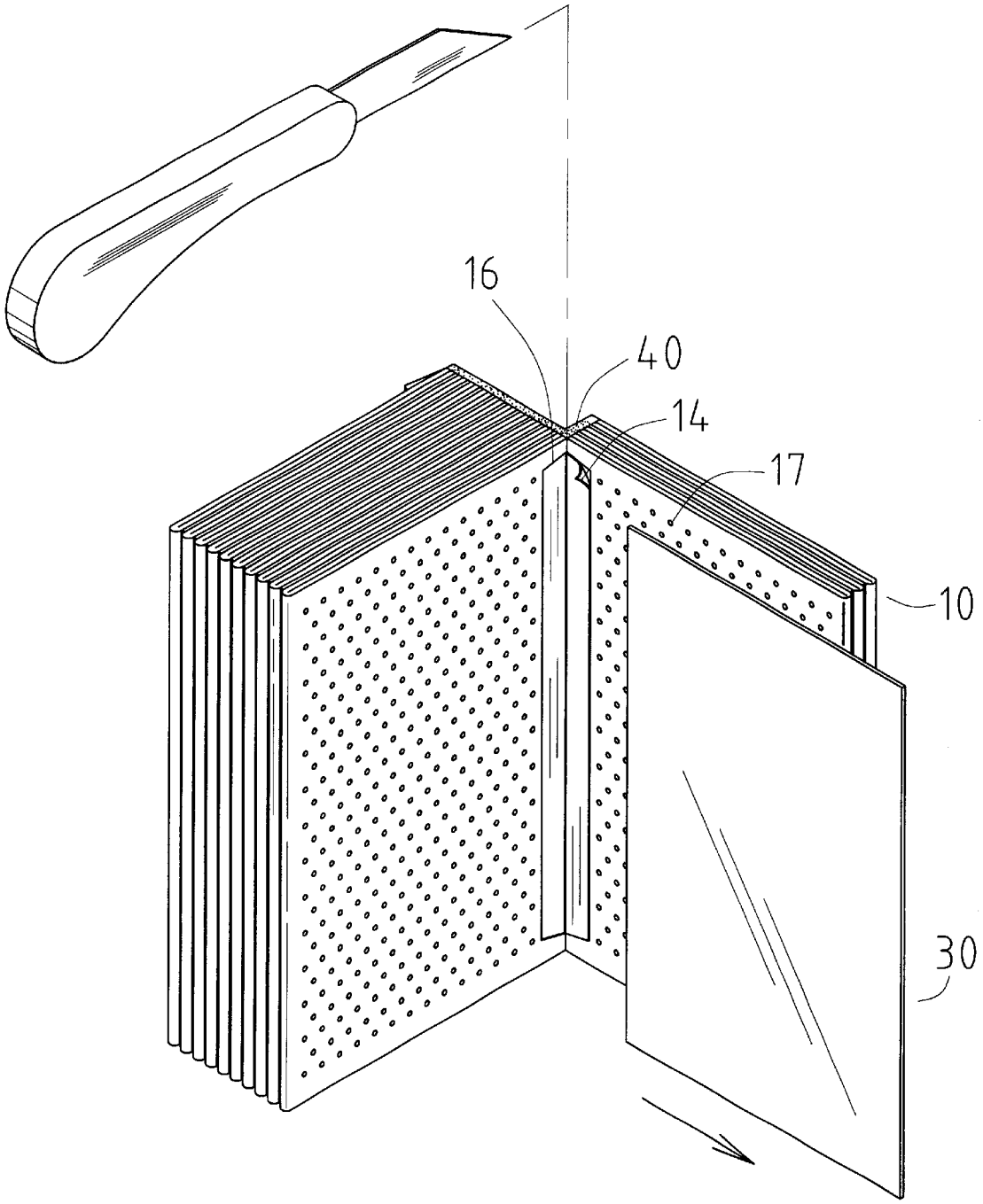
FIG. 8 is a perspective view illustrating the cutting of adhesive member of bound leaves of FIG. 4.

Referring to FIG. 8, user can use a knife to cut out the unnecessary number of leaves 10 from the finished album (e.g., comprising 150 pages) in order to obtain a desired number of leaves 10.

Figure 9:
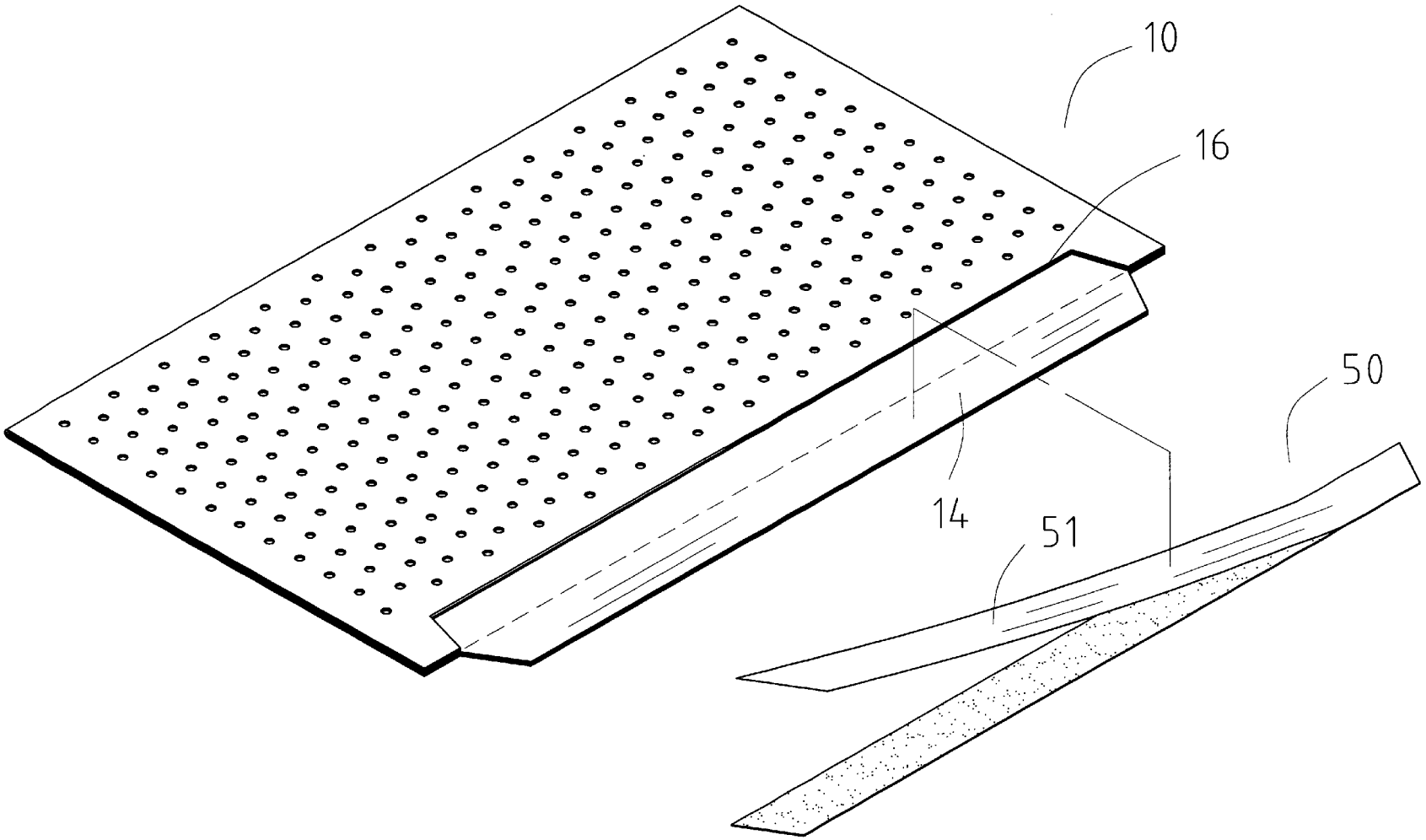
FIG. 9 is a perspective view illustrating the adhesion of a double-coated adhesive tape to the projection of leaf of FIG. 4.
Figure 10:
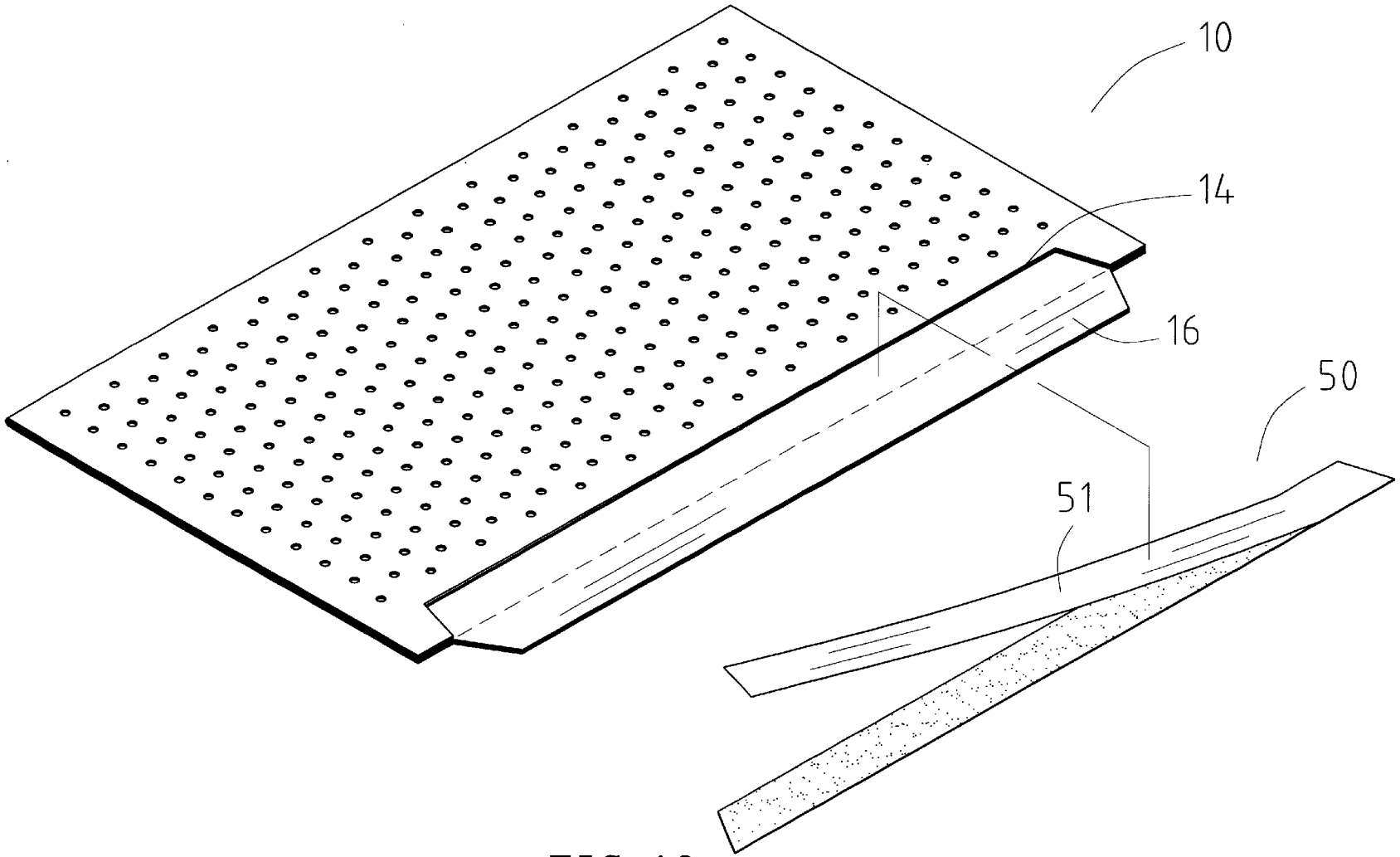
FIG. 10 is similar to FIG. 9, where the adhesion of a double-coated adhesive tape to the recess of leaf of FIG. 4 illustrated.

It is possible to adhere a double-coated adhesive tape 50 on either projection 14 (FIG. 9) or recess 16 (FIG. 10) in preparing leaves 10 in the above binding process. As such, simply remove the cover 51 of double-coated adhesive tape 50 after finishing the binding of album because projection 14 of one leaf 10 has registered with the recess 16 of adjacent leaf 10. Alternatively, the step of adhering double-coated adhesive tape 50 may be eliminated. Instead, user may buy glue to adhere projection 14 and recess 16 by him/herself. This can even lower the cost. Above unnecessary leaves 10 in the binding one album may be stored for future use. Thus, there is no problem of waste.

Figure 11:
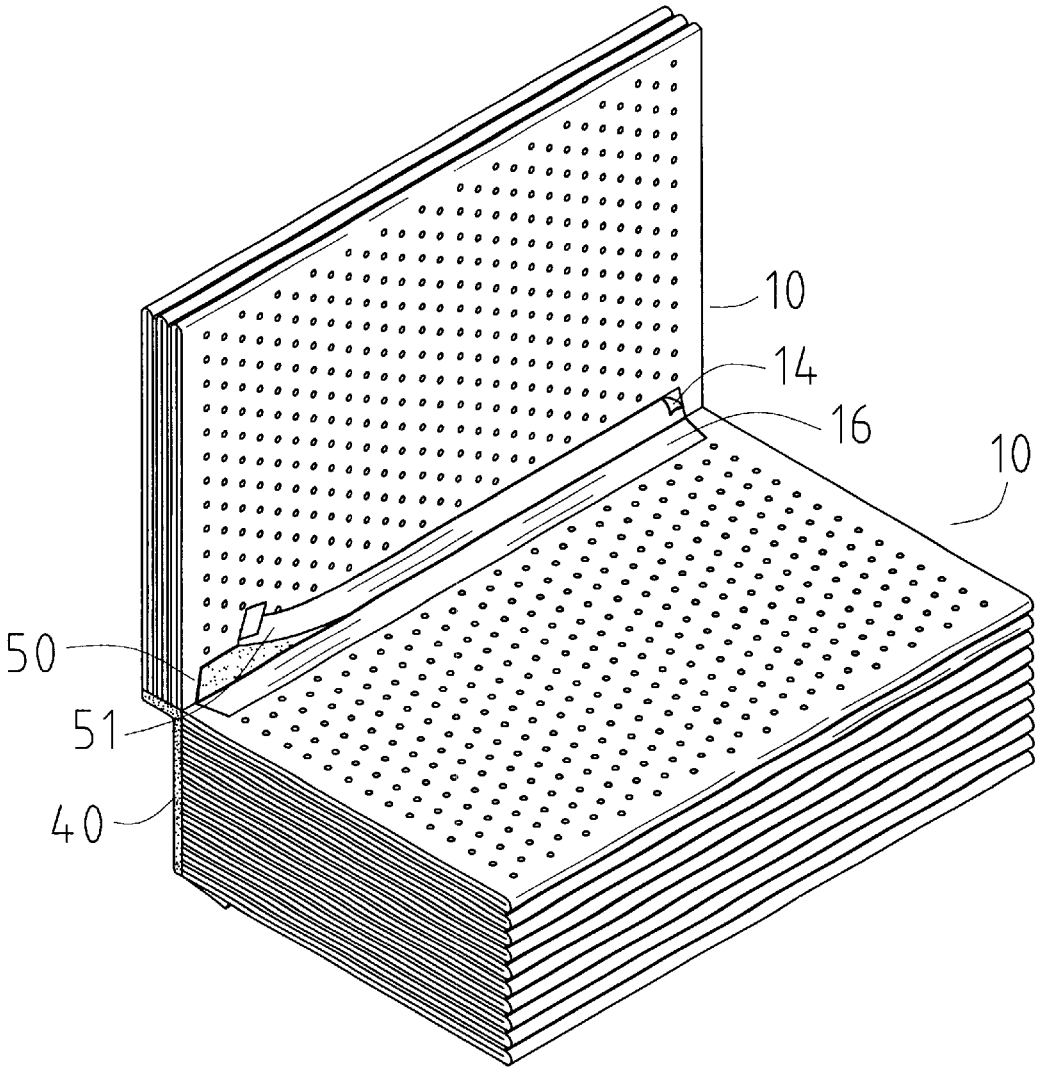
FIG. 11 is a perspective view illustrating the binding of leaves of FIG. 4.

Referring to FIG. 11, the removal of cover 51 of double-coated adhesive tape 50 from projection 14 is further illustrated.

Figure 12:
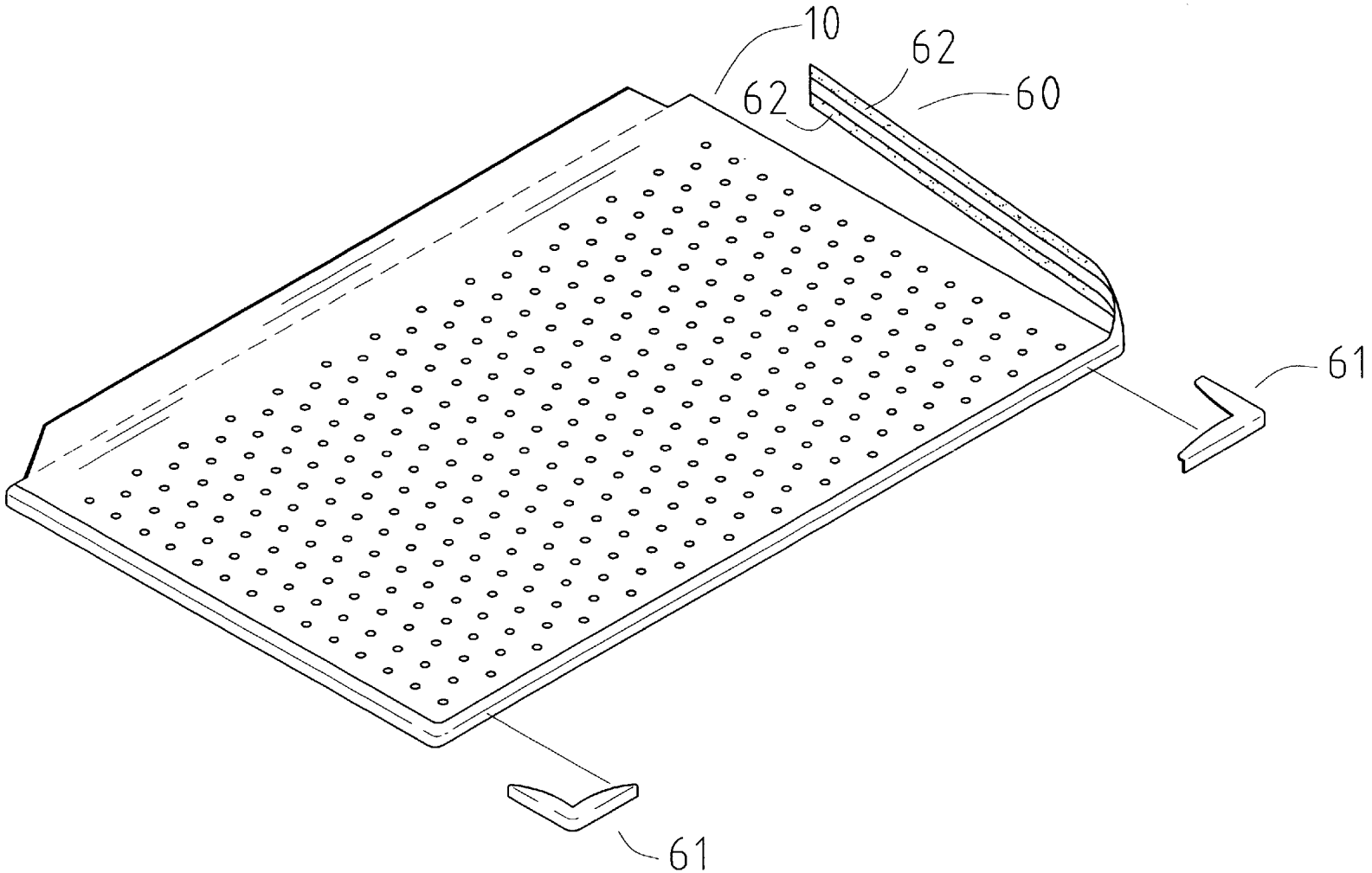
FIG. 12 is an exploded perspective view illustrating the mounting of band and trim on the leaf of FIG. 4.
Figure 13:
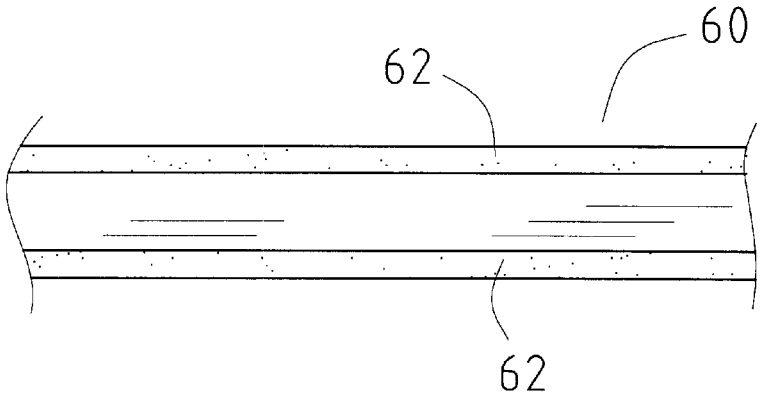
FIG. 13 is a plan view of the band of FIG. 12.
Figure 14:
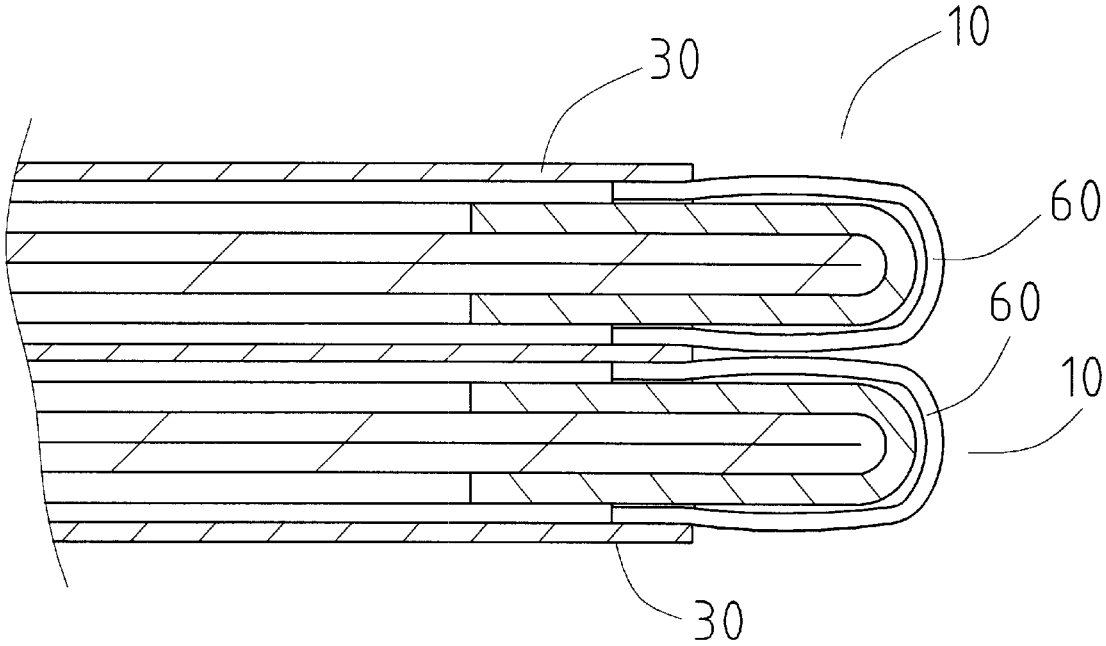
FIG. 14 is a cross-sectional view illustrating the mounted band on the leaf of FIG. 4.
Figure 15:
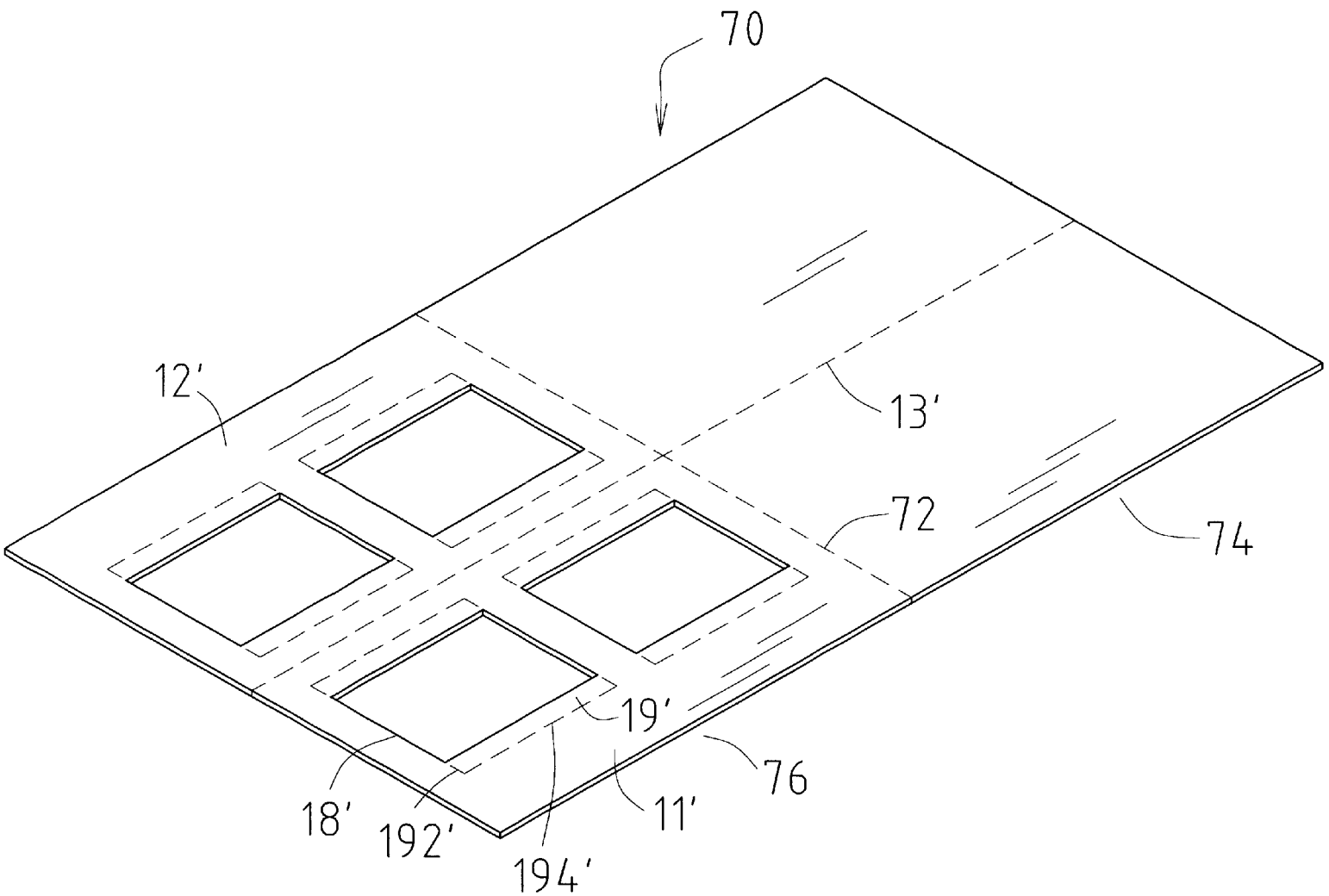
FIG. 15 is a plane view of a second preferred embodiment of an original leaf according to the invention.

Referring to FIGS. 12, 13, and 14, it is shown that a band 60 having a color of gold, silver, or any of other suitable colors is wrapped around three sides other than the binding side. Band 60 has a central non-sticky portion and two abutted sticky portions 62 for adhering to the sides of leaf 10. The central non-sticky portion is projected slightly. This can reduce the possibility of air contacting with pictures. The provision of band 60 can also avoid deckle edge of leaf 10 after a relatively long time of use of album. The provision of trims 61 on two corners of leaf 10 can protect leaf 10 from being deformed.

Referring to FIGS. 15 to 18, a second preferred embodiment according to the invention is illustrated. The rectangular piece of paper 70 has a thickness about the same as the thickness of picture or slightly larger than that of it. A first perforation 13' and a third perforation 72 are punched to divide the piece of paper 70 into four identical regions. The upper part of the piece of paper 70 is cover 74, while the lower part is leaf 76 as demarcated by third perforation 72 (see FIG. 15). Similarly, the right part of leaf 76 is first half leaf 11', while the left part of leaf 76 is second half leaf 12' as demarcated by first perforation 13'. Each of half leaves 11' and 12' has two identical rectangular openings 18'. Perforations 192' and 194' are provided adjacent the longer sides of openings 18'. An adhesive strap 19' is formed in the area surrounded by perforations 192' and 194' and the longer side of opening 18'.

Figure 16:
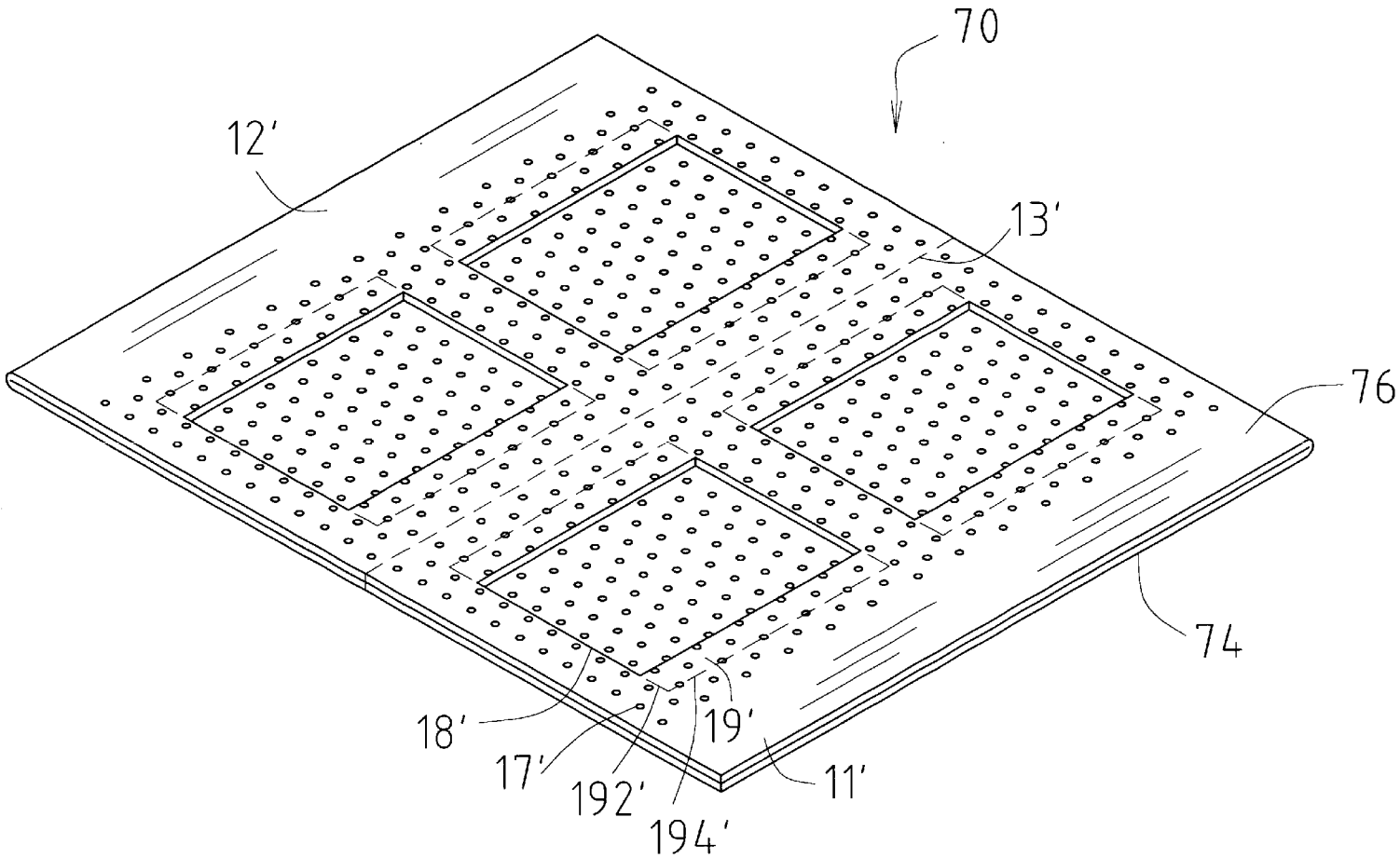
FIG. 16 is similar to FIG. 15 illustrating a preparing step of leaf of FIG. 15.
Figure 17:
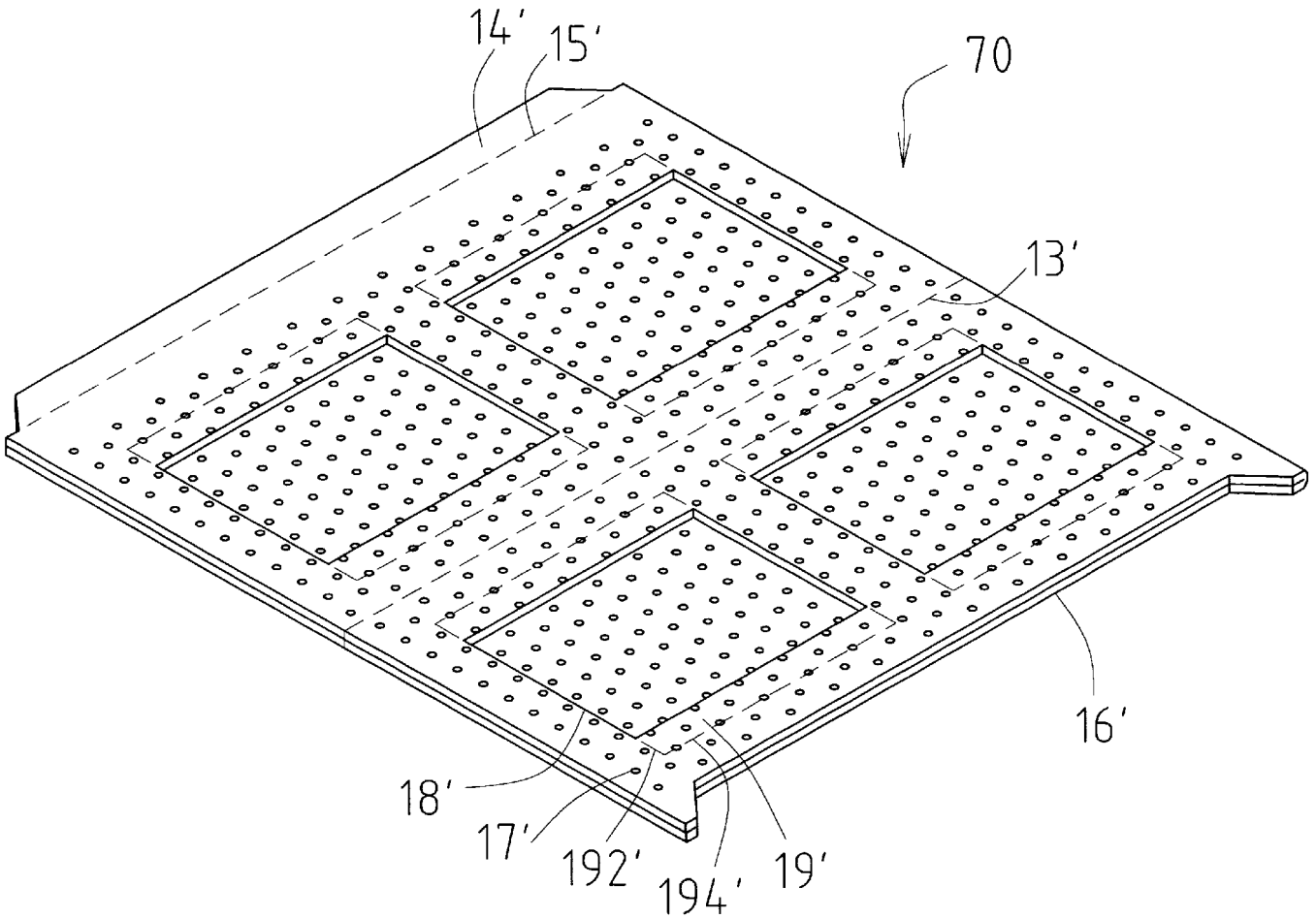
FIG. 17 is similar to FIG. 16 illustrating a further preparing step of leaf of FIG. 15.
Figure 18:
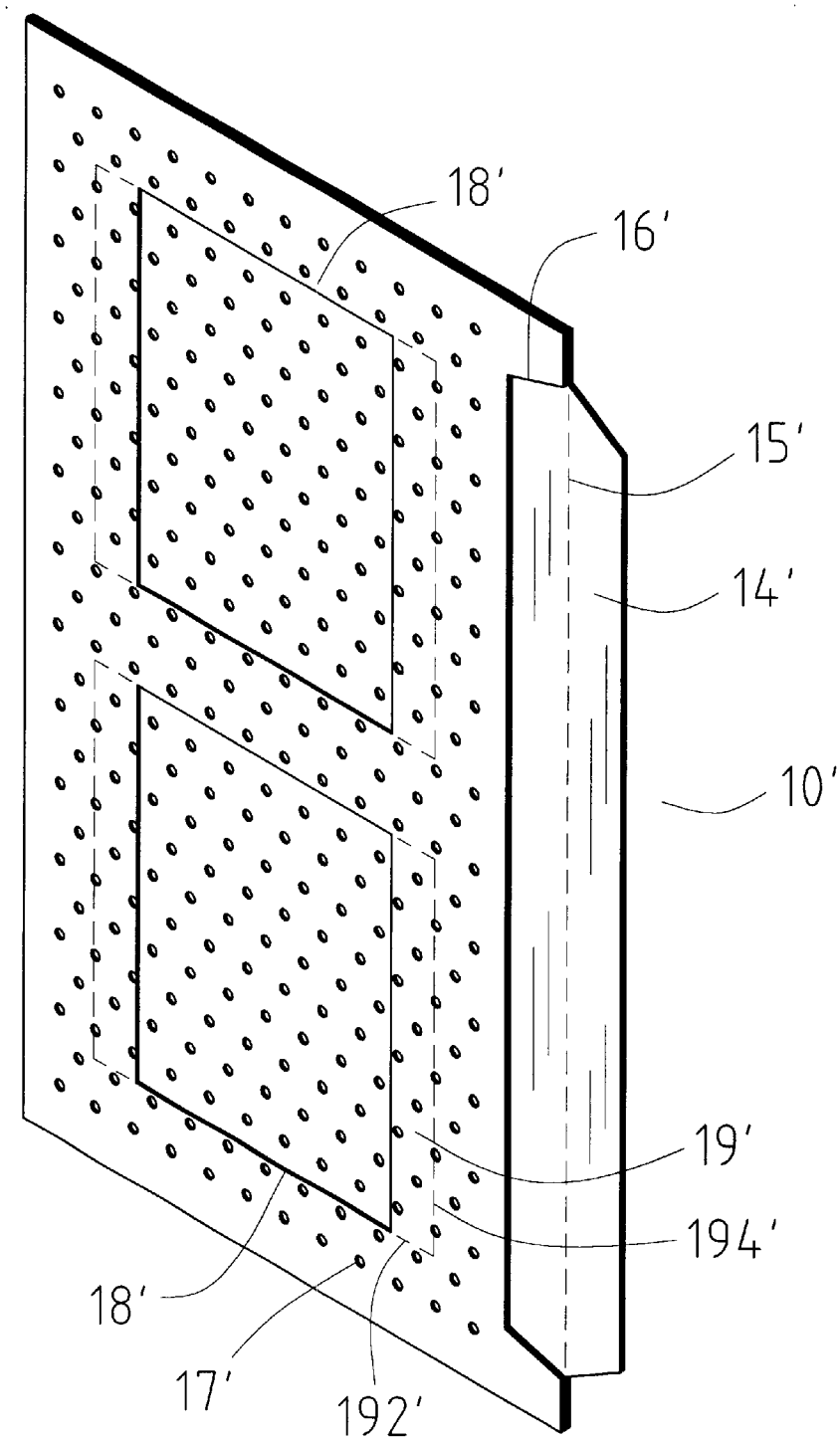
FIG. 18 is a perspective view of a prepared leaf of FIG. 15.

Similar to the first embodiment, each of half leaves 11' and 12' has a plurality of through holes 17' arranged in rows and columns wherein holes 17' in the first half leaf 11' correspond to holes 17' in the second half leaf 12' (FIG. 16). Punch a projection 14' on one side of second half leaf 12', a second perforation 15' along the inner edge of projection 14', and a matingly shaped recess 16' on the other opposed side of first leaf 11' (FIG. 17). Cover 74 is folded toward leaf 76 with respect to third perforation 72. Reversely fold projection 14' with respect to second perforation 15'. As a result, two binding sides are formed, i.e., projection 14' on one side while recess 16' on the other side. This completes the preparation of a single leaf 10' (FIG. 18).

Pictures may be glued in the area enclosed by openings 18'. Further, the mounted pictures may not increase the thickness of album. The cover of adhesive strap 19' may be removed from one side of opening 18' to adhere the other opposed side for accommodating to various sizes of pictures.

Figure 19:
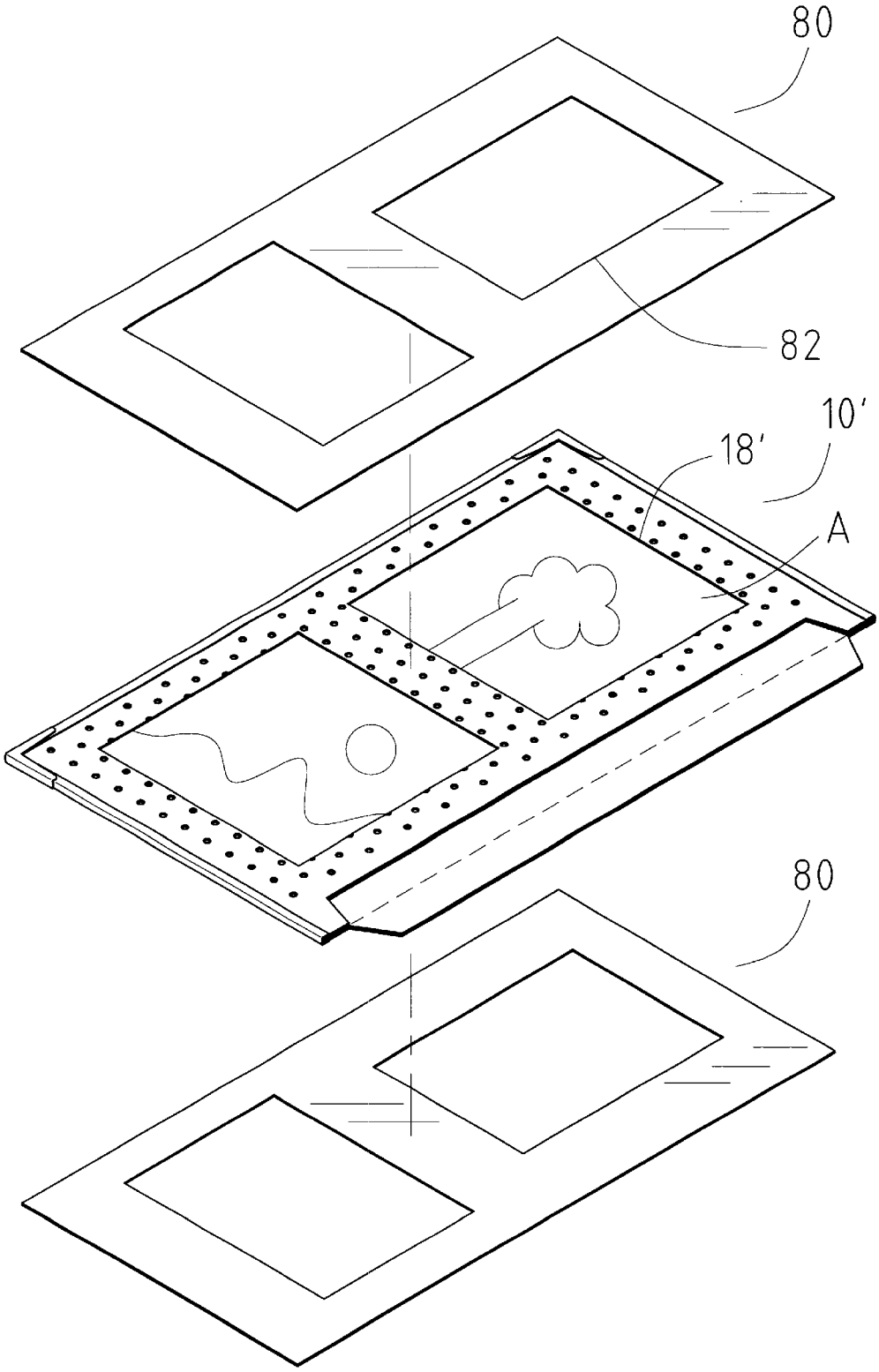
FIG. 19 is an exploded view illustrating the securing of frames to pictures mounted on the leaf of FIG. 18.

Referring to FIG. 19, there are two paper frames 80 (e.g., one on top and the other one on bottom) are mounted on leaf 10'. Each of paper frames 80 has two openings 82 which are smaller than the openings 18'. Viewer can see picture A through paper frame 80. The provision of paper frames 80 can protect pictures A and serve as a decoration.

While the invention herein disclosed has been described by means of specific embodiments, numerous modifications and variations could be made thereto by those skilled in the art without departing from the scope and spirit of the invention set forth in the claims.

What is claimed is:

1. An album comprising a plurality of leaves each having a longitudinal central perforation, a projection on one side, a matingly shaped recess on the other opposed side folded to the projection with respect to the longitudinal central perforation, and a plurality of through holes for reducing a weight and reducing a strain of the leaves caused by a variation of temperature and humidity, a plurality of openings on a first half of each of the leaves and a second half of each of the leaves and a cover folded to cover the first half of each of the leaves and the second half of each of the leaves.

2. The album of claim 1, wherein the holes are arranged in rows and columns with the holes in one half of the leaf corresponding to the holes in the other half of the leaf.

3. The album of claim 1, wherein each opening has a rectangular shape and further comprising a first perforation adjacent to a longer side of the opening, a second perforation connected between one end of the first perforation and the longer side of the opening, a third perforation connected between the other end of the first perforation and the longer side of the opening, and an adhesive strap surrounded by the first, the second, and the third perforations, a cover of the adhesive strap being removable from one side of the opening to adhere the other opposed side thereof for accommodating to various sizes and pictures.

4. The album of claim 1, further comprising a plurality of paper frames mounted on the leaf each comprising a plurality of apertures in communication with pictures.

5. The album of claim 4, wherein each aperture is smaller than each opening.

* * * * *